US005575362A

United States Patent [19]

Franklin et al.

[11] Patent Number: 5,575,362

[45] Date of Patent: Nov. 19, 1996

[54] COLLAPSIBLE PULL HANDLE FOR WHEELED GARMENT BAG

[75] Inventors: Dana Franklin; Bonnie M. Earl, both of Denver, Colo.

[73] Assignee: Samsonite Corporation, Denver, Colo.

[21] Appl. No.: 369,038

[22] Filed: Jan. 5, 1995

[51] Int. Cl.[6] ..... A45C 5/14; A45C 13/28

[52] U.S. Cl. ..... 190/115; 190/18 A; 190/39; 190/102; 16/115; 280/37; 280/655.1

[58] Field of Search ..... 190/18 A, 39, 190/115, 117, 102; 16/115, 112; 280/37, 655, 655.1

[56] References Cited

U.S. PATENT DOCUMENTS

| | | | |
|---|---|---|---|
| 2,427,841 | 9/1947 | Dichter . | |
| 3,606,372 | 9/1971 | Browning | 190/115 X |
| 3,895,696 | 7/1975 | Urushibara | 190/18 A X |
| 3,998,476 | 12/1976 | Kazmark, Sr. | 280/655 |
| 4,094,391 | 6/1978 | Ratchford | 190/115 X |
| 4,112,542 | 9/1978 | Snyder | 190/115 X |
| 4,538,709 | 9/1985 | Williams et al. | 190/18 A |
| 4,618,035 | 10/1986 | Mao | 190/18 A |
| 4,754,985 | 7/1988 | Im et al. | 280/655 X |
| 4,759,431 | 7/1988 | King et al. | 190/18 A |
| 4,917,401 | 4/1990 | Iwaki | 280/655 |
| 4,966,259 | 10/1990 | Bergman | 190/115 X |
| 4,995,487 | 2/1991 | Plath | 190/115 X |
| 5,127,664 | 7/1992 | Cheng | 280/655 |
| 5,167,306 | 12/1992 | Carrigan, Jr. | 190/18 A |
| 5,199,811 | 4/1993 | Huang | 403/108 |
| 5,253,739 | 10/1993 | King | 190/18 A |
| 5,291,976 | 3/1994 | Ku | 190/18 A |
| 5,295,565 | 3/1994 | Latshaw | 190/18 A X |
| 5,353,900 | 10/1994 | Stilley | 190/18 A |
| 5,355,980 | 10/1994 | Hsieh | 190/18 A X |
| 5,431,428 | 7/1995 | Marchwiak et al. | 280/37 X |

FOREIGN PATENT DOCUMENTS

| | | | |
|---|---|---|---|
| 2688986 | 10/1993 | France | 190/115 |

*Primary Examiner*—Sue A. Weaver
*Attorney, Agent, or Firm*—Rod D. Baker

[57] ABSTRACT

The invention relates to a telescoping pull handle for use in towing wheeled luggage. The handle may be collapsed to a reduced length to accommodate easy use with luggage that is carried onto and stowed in passenger transportation vehicles. The invention also is extendable to a sufficient length to permit the user comfortably to tow the wheeled luggage across a supporting surface. The invention includes incorporating into the telescoping handle devices permitting the user to strap or hook to the wheeled luggage auxiliary items of luggage. An improved extendable grip is disclosed for use with the inventive handle.

15 Claims, 8 Drawing Sheets

COLLAPSIBLE PULL HANDLE FOR WHEELED GARMENT BAG

BACKGROUND OF THE INVENTION

1. Field of the Invention

The invention relates generally to an article of wheeled luggage having a handle thereon for towing the luggage, and more particularly to a collapsible and extendable handle assembly for use on soft-sided wheeled garment bags.

2. Background Art

Much effort in the art of luggage design has been focused upon mounting wheels on the article of luggage and providing a "wheel handle" (sometimes called a "pull handle") with which to push or tow the luggage on its wheels across a supporting surface. A wide variety of wheel handle configurations have been devised, some mounted within the interior of the luggage, and others mounted upon the exterior. Additionally, it is known in the art to provide a wheel handle that may be more or less retracted into, and extended from, the article of luggage.

U.S. Pat. No. 5,253,739, assigned to the assignee of the present application, contains a useful exposition of and citations to the prior art. The disclosure describes a wheeled flight bag with a retractable pull handle. The wheels are connected at a lower corner of the bag, and a pull handle comprising one or more rods extends from and retracts into the bag. The wheels are connected to an internal support structure. The handle rods are movably connected to the internal support structure, and can be moved to extended and retracted positions. The pull handle serves to transmit torque between a grip (which the user holds to tow the bag on its wheels) and the internal frame structure of the bag. Each rod of the pull handle moves longitudinally within a channel of the support structure, and various elements are disclosed for allowing the sliding movement of the rods within the channels while also allowing the transmission of torque between the rod and the structural member.

Additionally, it is known in the art to provide devices allowing an auxiliary item of luggage to be temporarily attached upon a wheeled article of luggage, thereby allowing the wheeled luggage to serve as a cart or dolly for the auxiliary item. The main article of wheeled luggage typically is equipped with an extendable strap, the free end of which is wrapped around the auxiliary article and then releasably connected to the main article to secure the two pieces of luggage together. U.S. Pat. No. 4,759,431, assigned to the assignee of the present application, describes a travel bag with a combination pull handle and auxiliary bag strap. Here, a modular pull handle is fashioned to be incorporated into a wheeled piece of luggage, so that the handle can be extended for rolling movement of the luggage across a supporting surface. The handle unit also provides a system for controlling the strap which is adapted to secure auxiliary pieces of luggage to the wheeled piece of luggage. In several embodiments, the strap is incorporated into the handle and the assembly is designed to maintain the strap in a ready, deployable position upon extension of the handle assembly. The strap, upon being extended away from the handle, is automatically biased into its retracted position so that upon completion of its use, it is easily returned to its stored position within the handle assembly.

Carry-on luggage is increasingly popular with the traveling public. An advantage and requirement of carry-on luggage is its ability to fit beneath the seat or in an overhead compartment in an airplane or other transportation vehicle.

Much carry-on luggage is of the soft-sided variety, which consists of an inner frame surrounded by an outer shell made of pliable materials such as leather or fabric. Soft sided cases offer a number of advantages when used as carry-on luggage. They typically are lighter than hard sided cases of comparable size, and their flexibility allows them to fit into small or irregularly shaped spaces where comparably sized hard sided cases could not fit. The shape flexibility and reduced weight are particularly important to travelers who must be able to fit their carry-on luggage in the small and elevated storage spaces on typical commercial aircraft.

A widely used form of carry-on luggage is a garment bag. A garment bag allows items of clothing to be placed on hangers and then packed within the confines of the bag. After the clothing is hung on hangers in the garment bag, the garment bag is closed and folded to reduce its size. At the user's final destination, the garment bag is unfolded and typically is hung from a closet bar, and the clothes thereafter taken from and replaced directly into the garment bag. The flexibility of a garment bag allows the bag to be easily tucked into a small and crowded closet or bin on a transportation vehicle.

Attempts have been made to incorporate wheeled dollies with garment bags to allow a user to roll, rather than carry, the garment bag. One attempt to incorporate wheels and wheel handles into garment bags involves a dolly structure which requires the traveler to unfold the garment bag to its extended position, connect it to the extended dolly structure, and roll the garment bag along upright and in this extended position. The large extended configuration of the garment bag makes it difficult to maneuver in crowded airline, bus, or train terminals.

Even more problematic is the desirability of incorporating an extendable pull handle into a carry-on garment bag. The length and rigidity of known pull handle assemblies can decrease the flexibility of a garment bag to the point of dramatically impairing its utility as a carry-on article. Extendable handles known in the art have considerable length even when in a collapsed configuration. The considerable collapsed length of prior art extendable handles results from the need to provide a wheel handle which, when extended, is long enough to allow the user comfortably to tow the luggage without crouching or leaning. However, known extendable handles frequently are too long, even when collapsed, to allow the garment bag to be compressed and fit into a standard aircraft overhead compartment.

Accordingly, a need remains for an extendable wheel handle that extends to a comfortably useable length, but which also collapses to a sufficiently short length to be usefully incorporated into a carry-on soft-sided garment bag. A further need remains for an extendable wheel handle incorporating an auxiliary bag strap system. Against the foregoing background, and to overcome the unmet needs identified with the prior art, the present invention was developed.

SUMMARY OF THE INVENTION

The invention relates generally to an article of wheeled luggage having a handle thereon for towing the luggage, and more particularly to a collapsible and extendable wheel handle assembly for use on soft-sided wheeled garment bags. The wheel handle of the invention is used for gripping the article of wheeled luggage and moving it along the supporting surface, and consists of an intermediate handle member and a proximate handle member. The inventive wheel handle telescopically extends from the body of the luggage. The intermediate handle member is in slidable contact with guide rails rigidly disposed within the main body of the luggage, so that the intermediate handle member is adapted to be reversibly extended away from the main body of the luggage. The proximate handle member is reversibly retractable into the intermediate handle member. The intermediate handle member may be equipped with a retainer or housing, in which is located an extendable strap or hook element for releasably securing auxiliary items to the main body of luggage. The invention also includes a system for locking the intermediate handle member in a position extended from the main body and a system for releasing the lock to allow retraction of the intermediate handle member into the main body, as well as a mechanism for releasably retaining the proximate handle member in a position extended from the intermediate handle member. Also included in the scope of the invention is a combination of elements permitting the horizontal extension of the handle grip of the wheel handle assembly.

A primary object of the invention is to provide a telescoping pull handle apparatus for use with wheeled luggage.

Another object of the invention is to provide a laterally extendable handle grip apparatus for use with wheeled luggage.

A primary advantage of the invention is that a telescopically extendable and retractable handle is provided upon which may be mounted a strap or hook system for temporarily securing auxiliary items of luggage.

Another advantage of the invention is that a telescopically extendable and retractable handle is provided which retracts to a reduced length for use with soft sided carry-on luggage.

Another advantage of the invention is that a means is provided for increasing the ease and comfort of towing wheeled luggage behind the user.

Other objects, advantages and novel features, and further scope of application of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention, and together with the written description serve to explain the principles of the invention. The drawings are only for the purpose of illustrating a preferred embodiment of the invention and are not to be construed as limiting the invention. In the drawings.

DESCRIPTION OF THE PREFERRED EMBODIMENT (BEST MODE FOR PRACTICING THE INVENTION)

The improvements of the present invention are described in conjunction with a soft sided garment bag 20 shown in FIGS. 1–3 and 14–16, although the present invention may be advantageously utilized with a wide assortment of luggage articles of differing configurations, both soft and hard sided. Certain of the inventive features may find application outside the art of luggage design and manufacture.

For ease of description, "proximate" in the disclosure and claims shall mean nearer the user, e.g., nearer or toward the point where the user grasps the wheel handle assembly 30, unless otherwise noted. "Distal" shall have the opposite meaning unless otherwise noted. "Interior" or "interiorly" means nearer or toward the longitudinal axis of the wheel handle assembly 30, unless otherwise noted, and "exterior" or "exteriorly" likewise shall have the opposite meaning.

Figure 1:
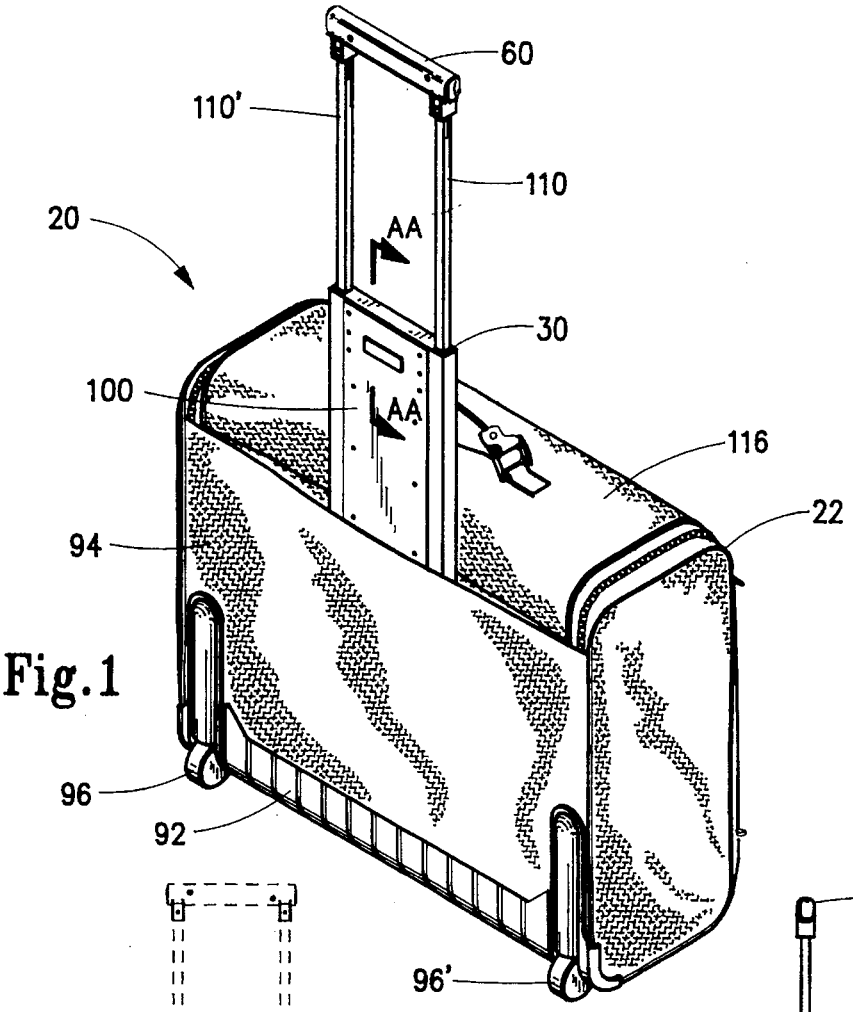
FIG. 1 is a perspective rear view of the preferred embodiment.
Figure 2:
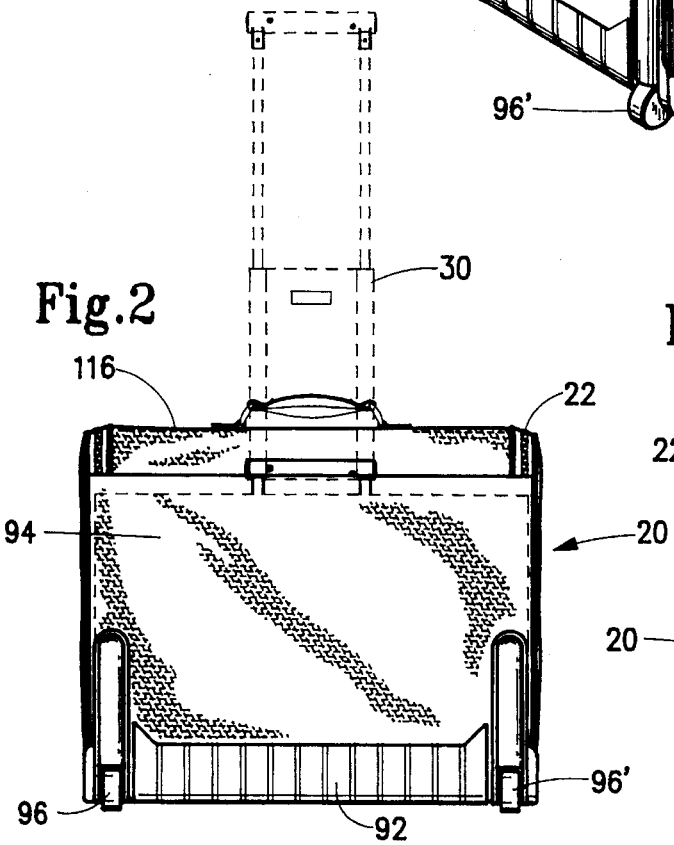
FIG. 2 is a rear view of the embodiment of FIG. 1.
Figure 3:
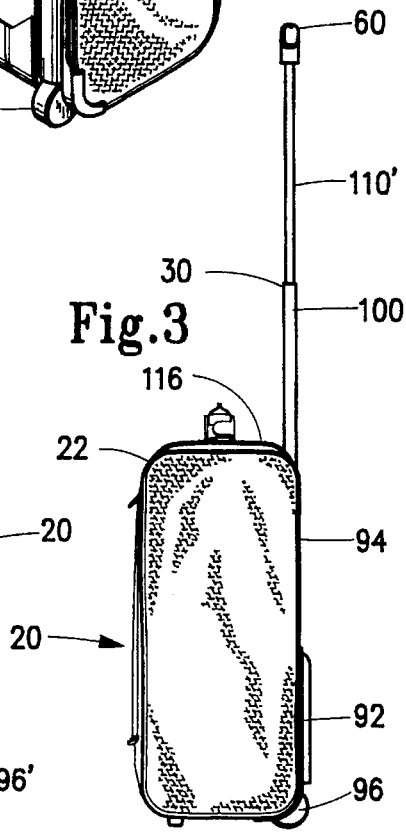
FIG. 3 is a right side view of the embodiment of FIG. 1.

Garment bag 20 is depicted in FIGS. 1–3. In the preferred embodiment, the bag 20 in a closed position as shown has a body 22 presenting a generally rectangular prismatic configuration defined by two side panels, a back, a front panel, a top and a bottom. The various panels thus define an enclosed space within which items may be contained. The body 22 is constructed of nylon, cloth, plastic, canvas, or other like flexible, durable material known in the art. The back 94 is generally planar, and is disposed in conjunction or integration with rigid pan 92. The top of body 22 is a top panel 116, which is sewn or otherwise permanently attached to body 22 along a seam with back 94. Top panel 116 is flexibly folded over from the back 94 and then brought in contact with the sides of the bag where it may be zippered, buckled or otherwise releasably secured into place to close the body 22.

Figure 14:
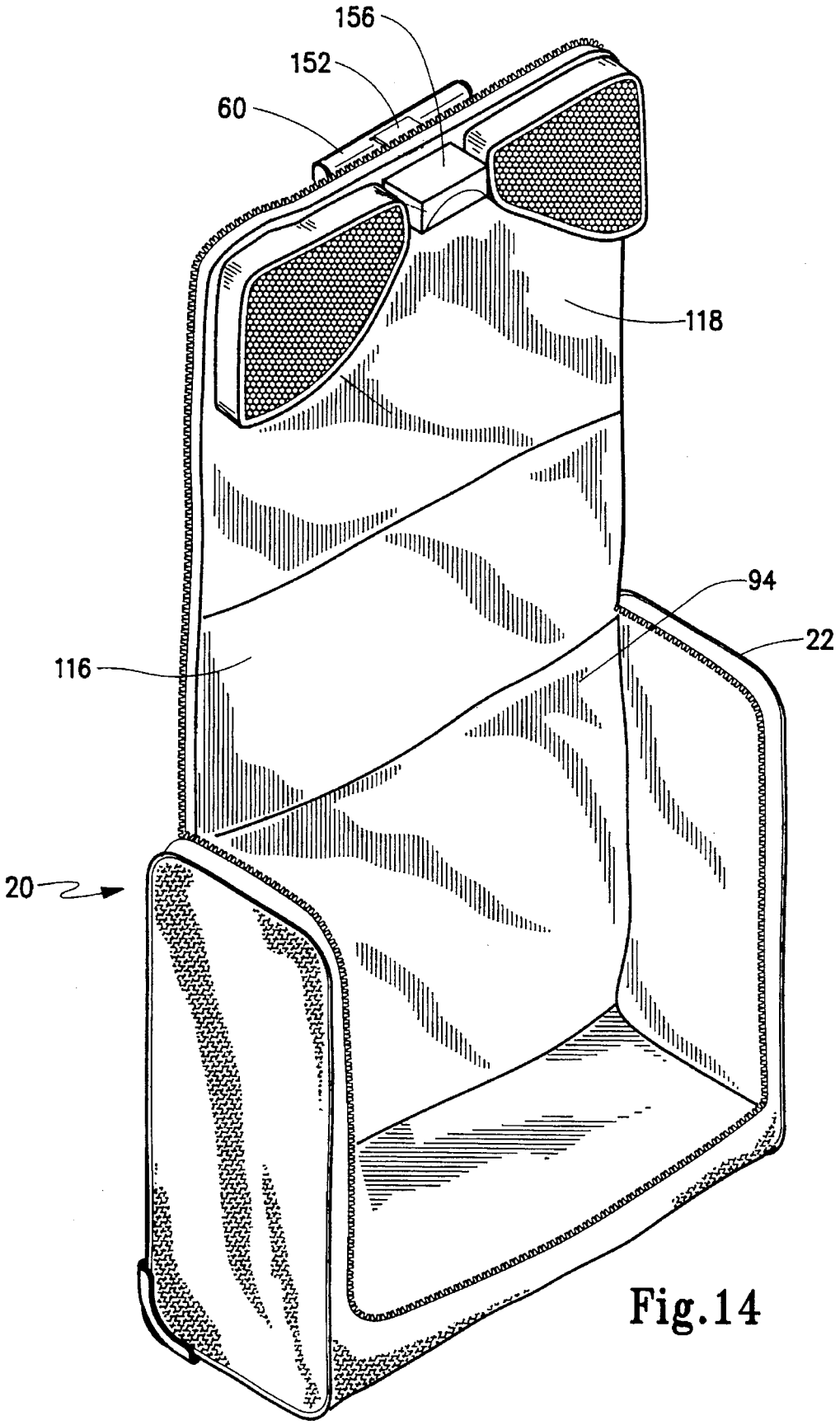
FIG. 14 is a perspective front view of the embodiment of FIG. 1.
Figure 15:
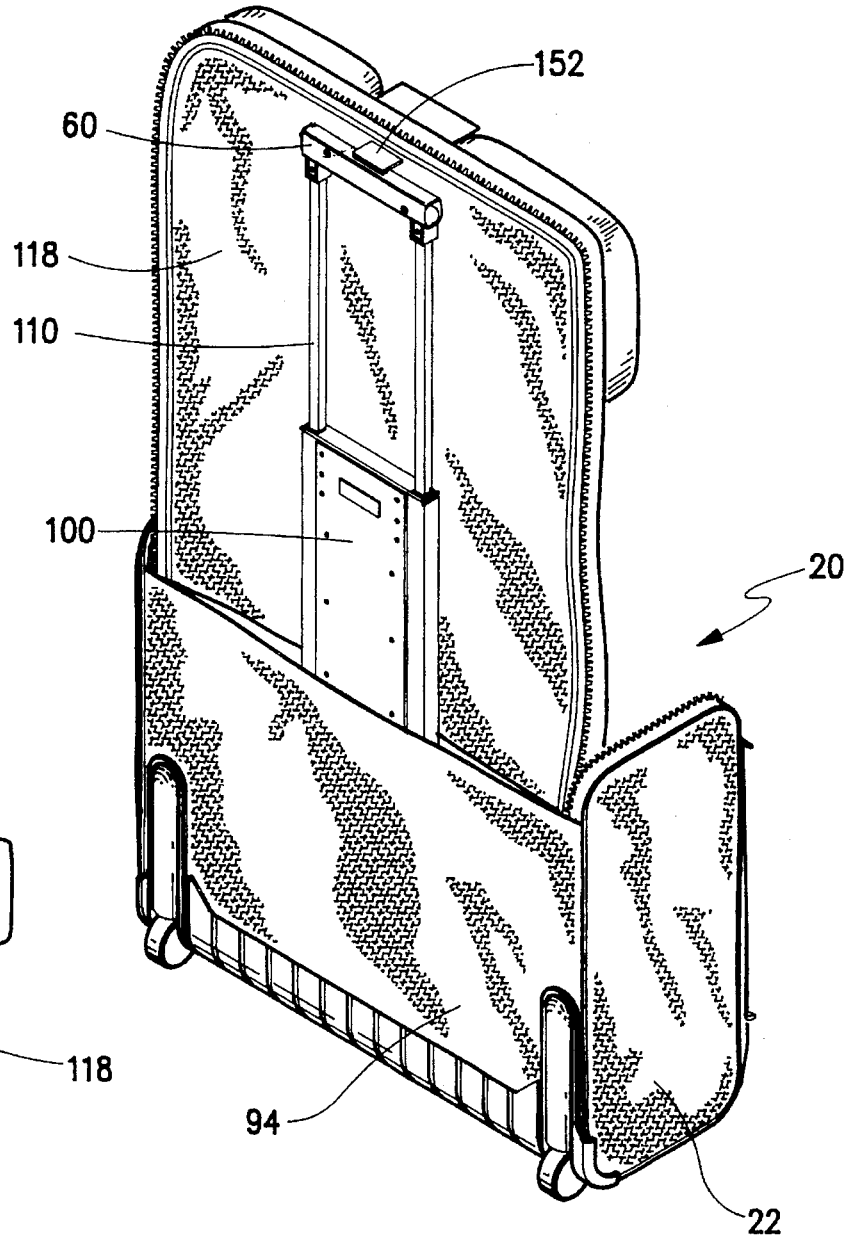
FIG. 15 is a perspective rear view of the embodiment of FIG. 14.
Figure 16:
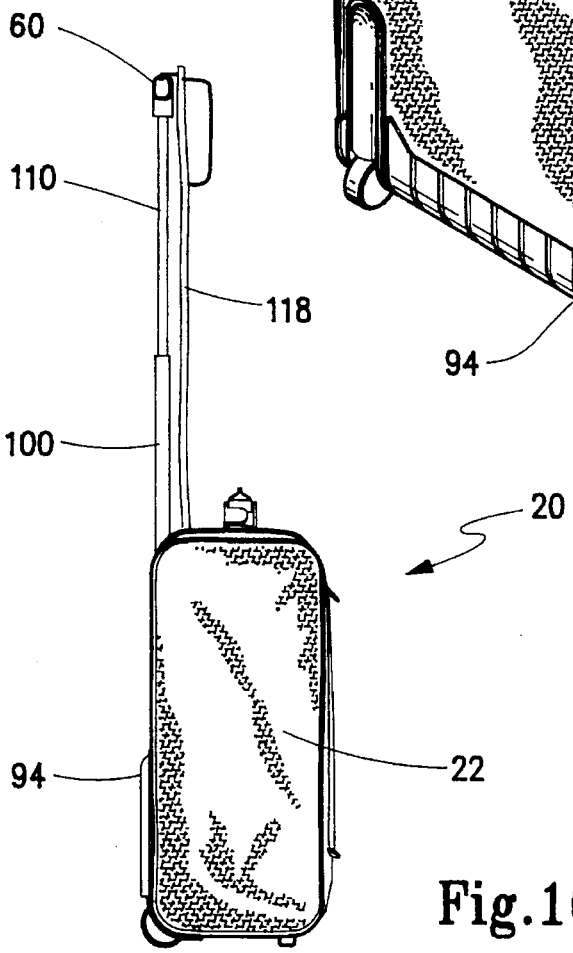
FIG. 16 is a left side view of the embodiment of FIG. 15.

The structure of bag 20 is also understood with reference to FIGS. 14–16, which show the bag 20 in a fully open position. In the preferred embodiment, top panel 116 has a flexible seam juncture with front flap 118. When the bag 20 is fully opened, front flap 118 is detached from the body 22 of bag 20, but remains flexibly connected to top panel 116, and both top panel 116 and front flap 118 are unfolded and extended upward to reveal the interior of the bag 20. When bag 22 is closed, as shown in FIGS. 1–3, top panel 116 and front flap 118 are folded down into position against the sides and front of the body 22 and there secured by buckle or zipper.

Figure 4:
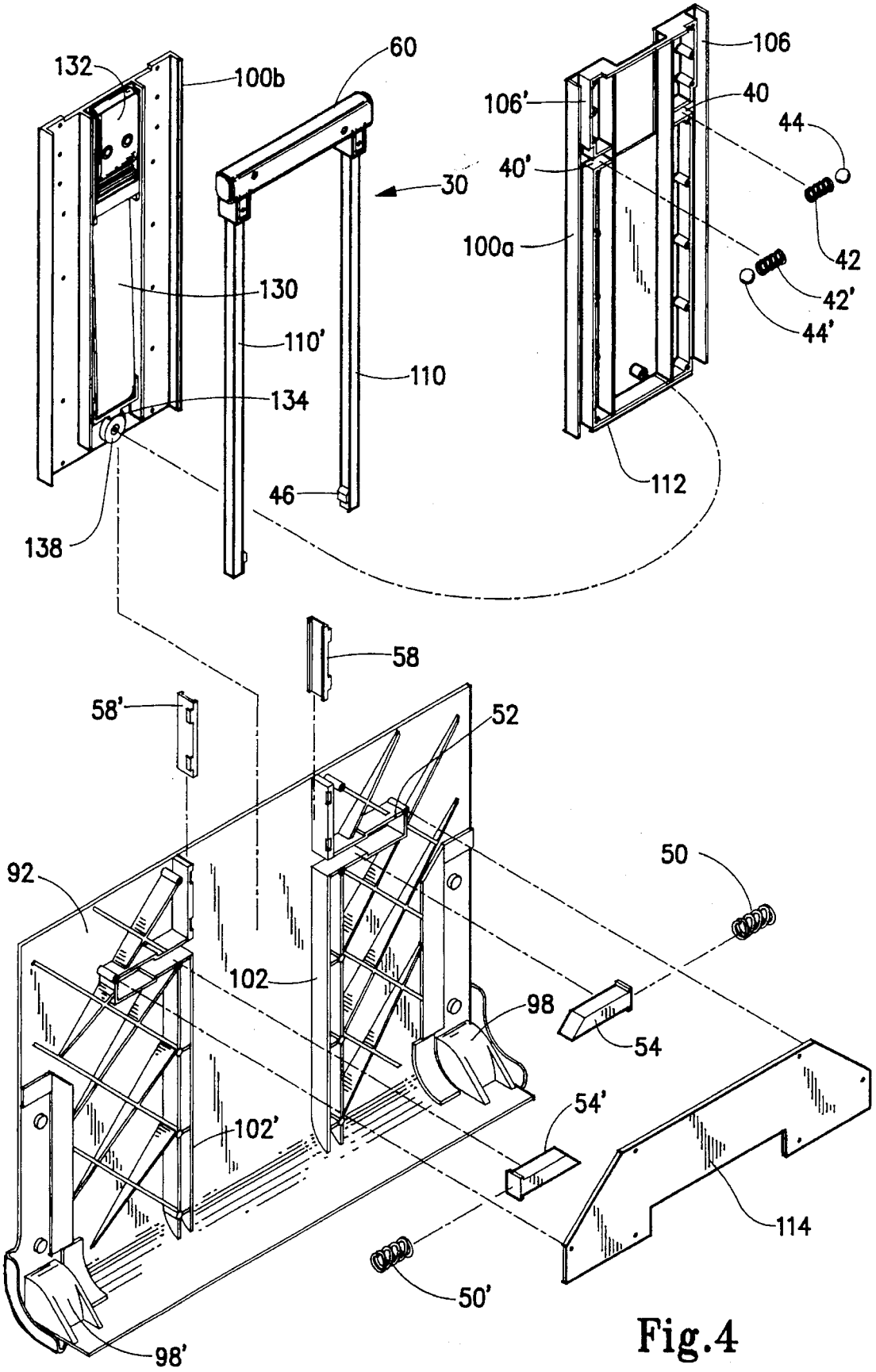
FIG. 4 is an exploded view of a portion of the embodiment of FIG. 1.
Figure 5:
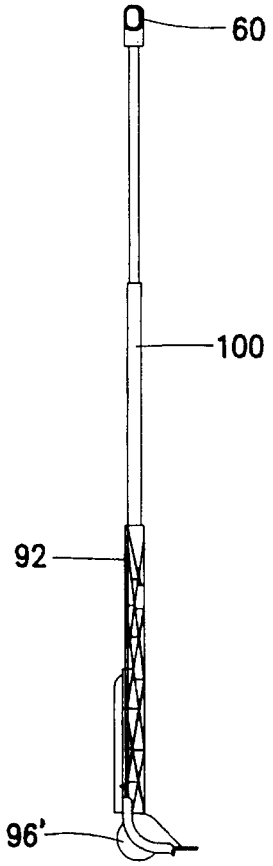
FIG. 5 is a left side view of the embodiment of FIG. 4.
Figure 6:
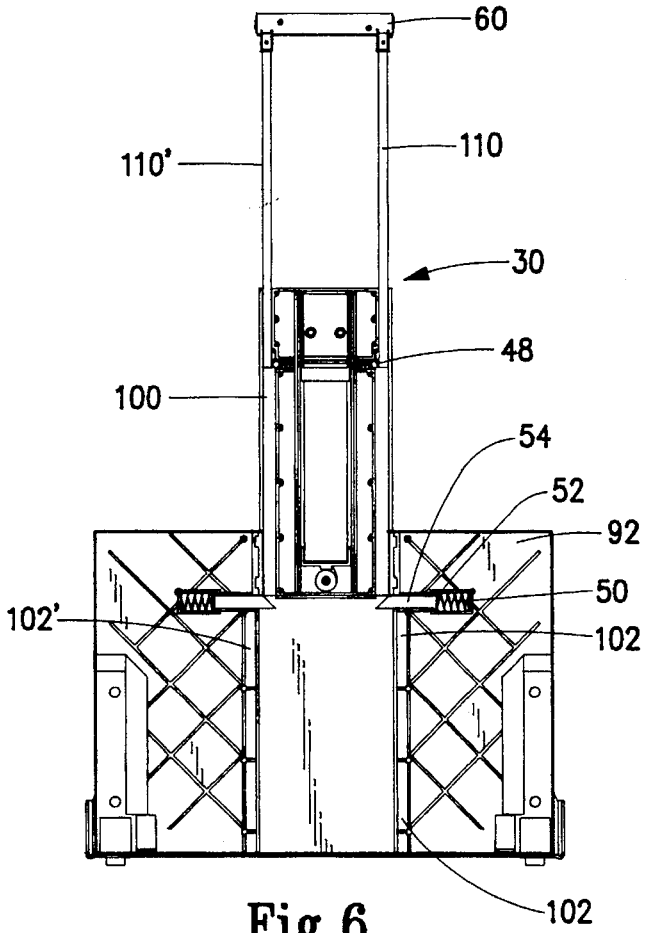
FIG. 6 is a front view of the embodiment of FIG. 4.

Since in the preferred embodiment the luggage consists of a soft sided garment bag 20, there is a need to provide an internal support structure for the back 94 to give the bag 20 weight-carrying capability when rolled upon a support surface, and to provide a substantial structure to which the wheel handle assembly 30 may be connected. The internal support structure consists principally of a generally planar bottom pan 92, best shown in FIG. 4, composed of a lightweight, rigid, and durable material such as ABS plastic or the like. Pan 92 extends substantially the full width, and a substantial portion of the height, of the bottom back panel 94 to provide support for the weight of the contents of bag 20 when the bag 20 is in the towing position. Wheels 96,96' are each securely positioned according to the art in corresponding wheel wells 98,98' formed in the bottom curved corner of pan 92. Upon the interior face of pan 92, and preferably forming an integral part thereof, are a pair of elongated, raised, rectilinear guide rails 102,102'. As shown in FIGS. 4 and 6, guide rails 102,102', in conjunction with pan 92, effectively function as elements of the pull handle assembly 30. Guide rails 102,102' are substantially parallel, and, as illustrated in FIG. 6, are separated by a distance generally corresponding to the width of housing 100.

Housing 100 serves as an intermediate handle member of the pull handle assembly 30. In the preferred embodiment, best shown in FIG. 4, housing 100 may be assembled from two halves 100*a*, 100*b* joined (as with screws, rivets, glue, or the like) to form a generally hollow, essentially box-like, rectangular prismatic member. Accordingly, besides serving as an integral structural component of the handle assembly 30, housing 100 additionally forms a cassette-like container. Housing 100 preferably is composed of a rigid durable plastic, such as styrene, ABS, or the like. Integrated into housing 100, preferably parallel to and along its respective longitudinal edges, are duct-like passages. Passage ducts 106,106' preferably consist of corresponding pairs of longitudinal channels formed directly in housing 100, so that passage ducts 106,106' are circular tubes or, in the preferred embodiment, rectilinear tunnels. Ducts 106,106' run the entire length of housing 100, providing orifices near each corner in both ends of housing 100.

Figure 7:
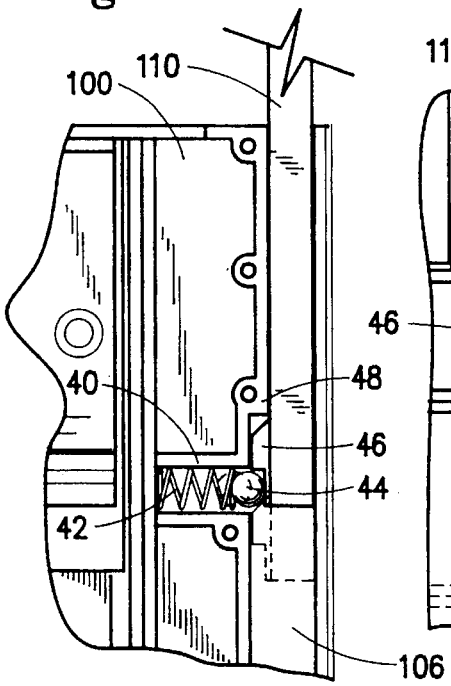
FIG. 7 is an enlarged view of a portion of the embodiment of FIG. 6.

Housing 100 slides against pan 92 and guide rails 102, 102' in directions parallel to guide rails 102,102'. Smooth, non-binding movement of housing 100 against rails 102,102' is fostered by bushings 58, 58' fashioned from nylon or other self-lubricating plastic. As seen in FIG. 7, bushing 58 is disposed so as to form a flush component of guide rail 102. Downward movement of housing 100 is arrested by contact of housing 100 with pan 92. Likewise, housing 100 may be telescopically extended out from pan 92; extension is limited by the contact of protruding stop lip 112 with the bottom edge of retaining cover 114. As seen in FIG. 4, retaining cover 114 is attached, as with screws, to pan 92 so that retaining cover 114 holds housing 100 against pan 92. Housing 100 may be withdrawn into a retracted or "collapsed" position wherein substantially the entire length of housing 100 is disposed between guide rails 102,102', and between pan 92 and retaining cover 114. It will be apparent to one skilled in the art that additional cover plates may be provided for holding the elements of the invention against the pan 92, but for the sake of clarity are not shown. Accordingly, the slidable disposition of housing 100 within the closely corresponding confines of pan 92, guide rails 102,102', and retaining cover 114 and other cover plates, and the resulting slidable connection between housing 100 and pan 92, allows transfer of torsional forces between housing 100 and pan 92.

Reference is made to FIG. 4, illustrating the elements forming the proximate portion of the wheel handle assembly 30, that is, the portion of the handle assembly 30 proximate to the user. In the preferred embodiment, the proximate handle consists of a pair of parallel rods 110, 110'. Rods 110, 110' preferably are made from a stiff resilient material, to resist both lateral bending as well as axial twisting from torsional forces. Fiber reinforced pultruded polyester resin rods are preferred. Rods 110, 110' telescopically extend from and retract into ducts 106,106' in housing 100. Mounted upon the proximate ends of rods 110, 110' is hand grip 60, which the user grasps to tow the luggage. Rectangular cross section rods 110, 110' are preferred, so that they may be disposed within the closely corresponding confines of ducts 106,106', and the resulting slidable connection between rods 110,110' and housing 100 allows rods 110, 110' to telescope between the extended and retracted position and to transfer torsional forces between hand grip 60 and housing 100.

An advantageous feature of the invention are the elements which allow rods 110,100' to be releasably retained in a position extended from housing 100. FIG. 7 shows that each duct 106 is constricted, at a location somewhat removed from the proximate end of housing 100, to provide stop ledge 48. Disposed distally adjacent to stop ledge 48 is a spring-and-ball detent system. The stop ledge and detent systems in each of ducts 106,106' are substantially identical, so that description of one serves to describe both. As shown by FIGS. 4 and 7, springs 42,42' are situated within respective boxes 40,40' integrated with the interior of housing 100. Each of the springs 42,42' is contained on all sides by its corresponding box 40 or 40' except that each of boxes 40,40' opens into duct 106. When expanded, spring 42 extends outward from box 40 into duct 106; when fully compressed, spring 42 is contained by box 40.

Associated with each of springs 42,42' is a corresponding ball 44 or 44', such as a steel ball bearing. Ball 44 is situated at exterior end of spring 42, such that the biasing force from spring 42 presses ball 44 from box 40 and into duct 106. Compressive forces applied inwardly against ball 44 can compress spring 42 and displace ball 44 out of duct 106 and into box 40. Ball 44 and spring 42 act as a detent in association with an end portion of rod 110 to releasably retain rod 110 in a position extended from housing 100.

Disposed upon (or forming an integral part of) the interior side of rod 110, near its distal end, is wedge shim 46. Wedge shim 46 influences the movement of ball 44 when rod 110 is moved up and down within duct 106. As seen in FIG. 7, shim 46 has an inclined or oblique face upon its proximate side, and a blunt, squared-off face upon its distal side. The shape of shim 46 assists in the proper function of the detent system.

Housing 100 functions as an intermediate handle member of the complete pull handle assembly 30. The pull handle assembly 30 is completely retracted when rods 100, 110' are fully retracted into housing 100, and when housing 100 is withdrawn between pan 92 and retaining cover 114. Likewise, the pull handle assembly 30 is optimally extended and fully usable as a wheel handle when both housing 100 and rods 110, 110' are fully extended, as shown in FIGS. 1, 3, 5 and 6, and by the phantom lines in FIG. 2.

Figure 8:
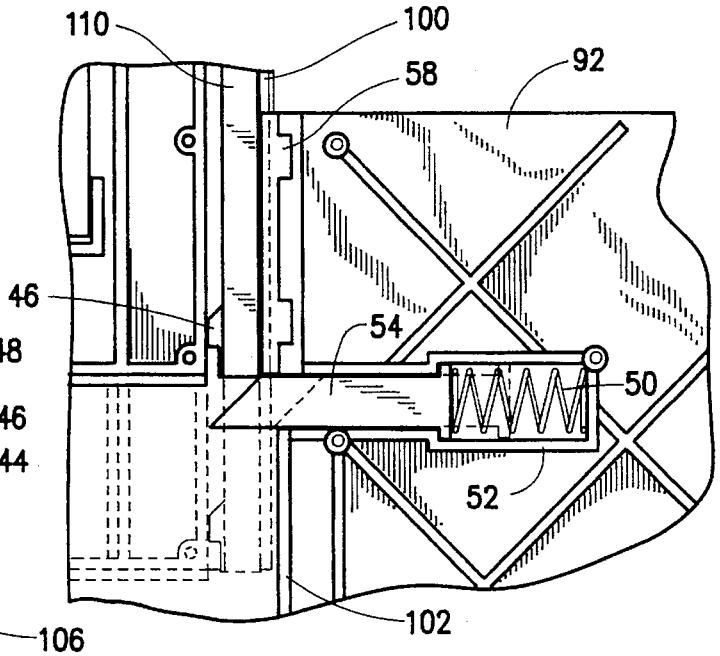
FIG. 8 is an enlarged view of another portion of the embodiment of FIG. 6.

Reference is made to FIGS. 6 and 8, showing the advantageous elements of the invention allowing housing 100 to be releasably locked in a position extended from pan 92. In the preferred embodiment, each of the guide rails 102,102' has a spring-and-catch system associated therewith that operates in relation with a corresponding side of housing 100. The locking systems pertaining to each of guide rails 102, 102' are substantially identical, so that description of one serves to describe both.

The releasable locking system consists of a pair of latch springs 50,50' with corresponding bolts 54,54' placed within respective compartments. Like guide rails 102,102', the walls of the compartment 52 preferably are formed as an integral part of the pan 92. Latch spring 50 is generally contained within compartment 52 by retaining cover 114, except that compartment 52 opens through the interior side of guide rail 102. When fully compressed, latch spring 50 is contained within compartment 52, and when released expands toward the interior of pan 92.

Operatively associated with latch spring 50 is bolt 54. As shown in FIG. 8, bolt 54 is situated in contact with the interior end of latch spring 50, such that latch spring 50 biases bolt 54 from compartment 52. Bolt 54 is sized to correspond substantially with the interior dimensions of compartment 52, so that bolt 54 may be disposed within compartment 52 in slidable contact with the walls thereof. Subject to the bias of spring 50, bolt 54 thus may reciprocate within compartment 52. Compressive forces applied against bolt 54 may compress spring 50 and displace bolt 54 into compartment 52. When latch spring 50 is in an uncompressed state, it pushes bolt 54 out of compartment 52 a certain distance into the glide path of housing 100.

Housing 100 may be pushed to a position partially or completely retracted into pan 92 and between guide rails 102,102', in which configuration bolt 54 is pushed against the side of housing 100 by the action of compressed latch spring 50, but side of housing 100 maintains bolt 54 mostly within compartment 52 against the force of latch spring 50. Housing 100 then moves easily past the retracted bolt 54, due to a sliding contact between the two.

Bolt 54 and latch spring 50 act in association with a corner portion of the distal end of housing 100 to lock housing 100 in a position extended from pan 92. When housing 100 is fully extended for use, much (but not all) of its length protrudes beyond the top of pan 92. A distal portion of housing 100 remains within the confines of the pan 92, guide rails 102,102' and retaining cover 114 to maintain the functional connection between housing 100 and pan 92. When fully extended, however, the entirety of housing 100 will be disposed above bolt 54, and bolt 54 emerges from compartment 52 to a protruding position, as shown by the solid lines in FIG. 8. Protruding bolt 54 extends into the area between guide rails 102,102' and below the distal end of housing 100. Retraction of the extended housing 100 thus is prevented by the contact of the distal end of housing 100 with the protruding bolt 54, and housing 100 is thereby locked in the extended position.

As best seen in FIG. 8, bolt 54 has an inclined oblique surface upon the proximate side of its interior end. This oblique surface of bolt 54 is so dimensioned as to present an inclined plane which may be contacted by the distal ends of both rod 110 and housing 100, as further described hereafter. The length of oblique surface (i.e., its absolute dimension measured perpendicularly from guide rail 102) is a fraction of the overall length of bolt 54. Continued reference to FIG. 8 shows that the proportion of the length of oblique surface to the total length of bolt 54, in further relation with the size of compartment 52, provides that bolt 54 extends beyond guide rail 102 a distance slightly greater than the length of the oblique surface. Accordingly, when bolt 54 is pushed out of compartment 52, most of its extended length consists of the length of the oblique surface, with a remainder (e.g. about 6.0 mm immediately adjacent to guide rail 102) presenting a flat surface perpendicular to guide rail 102. Even when bolt 54 is fully extended, however, a length of bolt 54 remains within the confines of compartment 52 to provide functional connection necessary to the utility of the locking assembly. The bolt's oblique surface permits the proper function of the system for releasing the locking elements to allow the retraction of housing 100 into pan 92.

In the preferred embodiment of the invention, there is a predetermined relationship between the length of housing 100, the length of rod 110, and the position of the bolt 54 and spring latch 50 assembly. Rod 110 serves the key function of initiating the displacement of bolt 54 into compartment 52, which in turn allows housing 100 itself to complete the displacement of the bolt 54 thereby allowing the distal end of housing 100 to clear the bolt 54 and slide down between guide rails 102,102' and into pan 92. This system for releasing housing 100 from its locked extended position has to do with the respective lengths of rod 110 and housing 100.

In the preferred embodiment, the effective length of rod 110 is somewhat longer (e.g., about 10 mm to 15 mm) than housing 100, such that when rod 110 is fully retracted into housing 100, an abbreviated length of rod 110 protrudes from the distal end of housing 100 near (e.g. approximately 10 mm from) the side of housing 100. The extension of rod 110 beyond the distal end of housing 100, which extension occurs only when rod 110 is retracted into housing 100, functions to actuate the release of the spring-and-bolt assembly which locks housing 100 in extended position for use.

An advantage of the invention is that housing 100 may function as a retainer for a strap or hook system for releasably securing auxiliary items of luggage to bag 20. FIGS. 4, 6, 9, and 17 show that such an auxiliary attachment system may be contained within housing 100. In the preferred embodiment, the auxiliary attachment system consists of a strap or belt 130 which is extendable from inside housing 100 through a slot 144 near the proximate end thereof. Fixed to housing 100 near slot 144 is a spring-actuated belt release lever 132. A spring closes lower leg 146 a clamp upon belt 130, preventing belt 130 from moving through slot 144. When the belt release and lock lever 132 is depressed, the clamp is disengaged and the belt 130 is freed to move in or out of housing 100 through slot 144. Within housing 100 is a shuttle 134 that is slidable up and down within housing 100. Mounted upon shuttle 134, are rollers 142 which act as belt pulleys around which belt 130 is passed. The use of rollers permits belt 130 to be rollably folded back upon itself, permitting a great length of belt 130 to be stored within the length of housing 100. Shuttle 134 is connected to housing 100 by one or more constant force springs 138, which bias shuttle 134 downwardly in housing 100, and tend to roll belt 130 around rollers 142 and retract belt 130 into housing 100. One end of strap 130 is permanently secured to the interior of housing 100, while the free end passes through slot 144 and is used to secure auxiliary luggage to the main bag 20. This free end of belt 130 is fitted with a hook 140 that is releasably engageable with the exterior of housing 100 to store belt 130 when not in use, and also to attach belt 130 to handle assembly 30 when strap 130 is in use.

Figure 9:
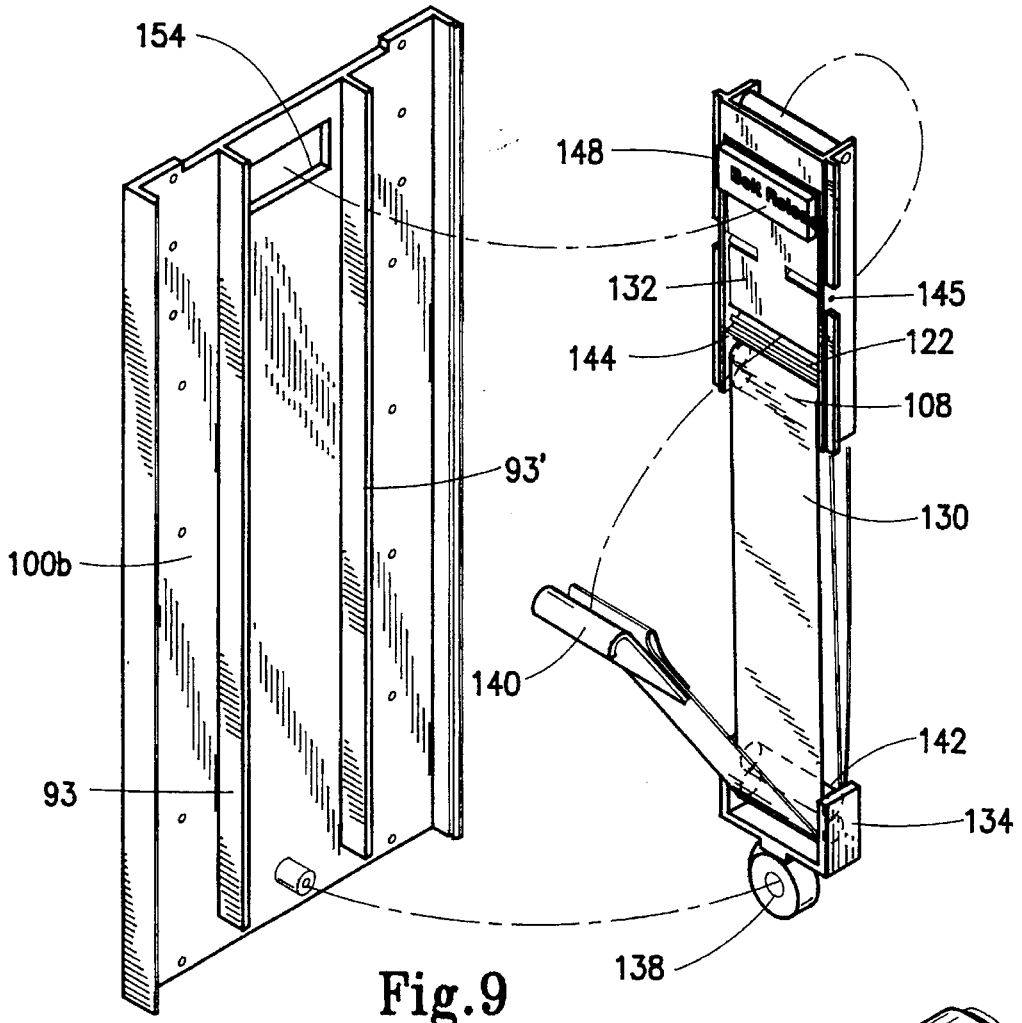
FIG. 9 is an enlarged exploded view of the intermediate handle assembly portion of the FIG. 4 embodiment.
Figure 17:
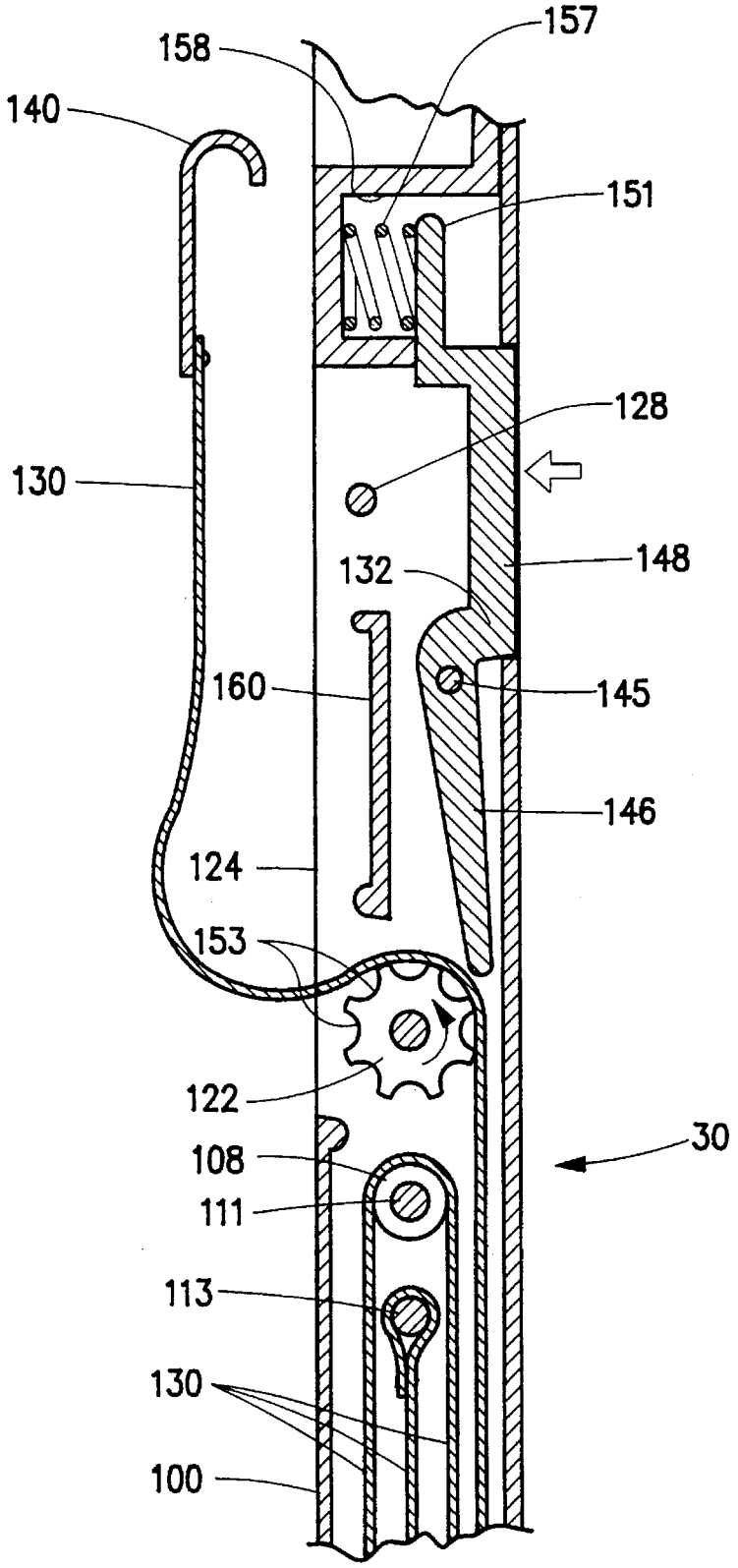
FIG. 17 is a right side sectional view of the FIG. 1 embodiment, taken substantially along AA—AA in FIG.1.

The auxiliary luggage attachment system as is best seen in FIGS. 9 and 17 includes a fixed upper roller 108 mounted on a transverse shaft 111 and a fixed upper pin 113 mounted immediately below the fixed roller 108, with the ends of the pin and the roller shaft being seated in aligned cylindrical recesses in the inner ribs 93, 93'. The shuttle element 134 is disposed for vertical reciprocal movement in the space defined between the two inner ribs 93, 93'.

The free end of the belt 130 extends outwardly through an opening 124 provided in the bottom of the housing 100*b* and carries a hook 140 which can be releasably set on a transverse anchor shaft 128 mounted in the housing 100 above a star wheel 122 in a spaced location therefrom. The transverse anchor shaft 128 has its ends set in aligned cylindrical recesses in the inner ribs 93, 93'.

In this manner, it will be appreciated that upward movement of the shuttle element 134, as will be experienced as the belt 130 is pulled out of the housing 100 to its extended position, will be yieldingly resisted by the constant force spring 138 so that upon release of the belt 130, the spring will pull the shuttle downwardly, thus retracting the belt 130 to its stored position.

As best seen in FIG. 17, a belt release lever 132 is mounted on a pivot shaft 145 whose ends are also journaled in aligned cylindrical recesses in the inner ribs 93, 93', and the lock lever serves to cooperate with the star wheel 122 in selectively retaining the belt 130 in any one of an infinite number of extended positions. The lock lever is made from a relatively rigid piece of material and has a lower leg portion 146, a contact plate 148 and an abutment tab 151. The lower leg portion 146 is adapted to protrude generally into any one of the longitudinal grooves 153 provided in the surface of the star wheel 122 to lock the belt 130 in a selected position but can be moved out of the groove 153 by depressing the contact plate 148 which is immediately above the pivot shaft 145 so as to pivot the lower leg in an opposite direction. The contact plate is exposed through a rectangular opening 154 provided in the housing 100*b* so that it can be easily accessed when operating the belt 130. The abutment tab 151 is disposed immediately above the contact plate 148 in confronting relationship with a coil spring 157 seated in a pocket 158 provided in the housing 100 with the coil spring biasing the lock lever into a locking position with the lower leg extending into a groove in the star wheel. The bias of the coil spring, however, is easily overcome by depressing the contact plate 148 as shown in FIG. 17 thereby compressing the coil spring and allowing the lower leg 146 to be moved out of a groove 153 on the star wheel. In this position the belt 130 is free to move in the space between the lower leg 146 and the star wheel 122 when the belt 130 is being extended or retracted. A vertical rib 160 is also formed on the housing 100 immediately above the star wheel 122 so as to retain the belt 130 in close relationship to the star wheel so that the desired cooperation between the lock lever and the star wheel is dependably retained. In operation of the belt 130, it is removed from the anchor shaft 128 while depressing the contact plate 148 on the lock lever to release the belt 130 from the star wheel 122 so that it is free to move outwardly to its extended position. Alternatively, the auxiliary attachment system may be assembled and configured as disclosed in U.S. Pat. No. 4,759,431, which is similar to the described embodiment, except that an elastic cord and pulley system is used in lieu of a constant force spring. Rigid pivotable hooks and linked belts are other alternative attachment systems.

The practice of the invention may now be explained. Combined reference is made to FIGS. 1–9. When wheel handle assembly 30 is not in use, housing 100 is fully retracted into pan 92, and rods 110,110' are fully retracted into housing 100 (see solid lines in FIG. 2 and phantom lines in FIG. 8). Retraction of rods 110, 110' is limited by the contact of handle grip 60 with the proximate end of housing 100. In this configuration, shim 46 is located below ball 44. To use the wheel handle assembly 30, rod 110 is withdrawn by the user, who may steady the bag 20 with one hand and pull upward on handle grip 60 with the other.

During the withdrawal of rods 110,110' from housing 100, the housing 100 is held in its retracted position by minor friction between housing 100 and pan 92, between housing 100 and guide rails 102,102, and between the tips of bolts 54,54' and the sides of housing 100. In the preferred embodiment, the friction holding housing 100 in a retracted position exceeds the friction holding the rods 100,110' in a retracted position within housing 100. Consequently, pulling upward upon handle grip 60 initiates upward sliding movement of rods 100,110' before initiating upward movement of housing 100.

Continued pulling slides rod 110 along and out of duct 106, while ball 44 slides or rolls along the interior side of rod 110. Just prior to the rod's reaching its fully extended position, its upward movement will draw shim 46 into proximity with ball 44. Continued upward movement of rod 110 causes ball 44 to encounter the inclined face of shim 46 in a relationship depicted by the phantom lines of FIG. 7. Because rod 110 cannot move laterally within duct 106, as rod 110 moves still further upward in duct 106, the shim 46 acts as a wedge between rod 110 and ball 44 and nudges ball 44 laterally against spring 42 and at least partially into box 40.

Withdrawal of rod 110 continues until shim 46 contacts stop ledge 48, as shown by the solid lines of FIG. 7. Shim 46 will have cleared and moved above ball 44, which permits spring 42 to once again push ball 44 out of box 40 and against rod 110 immediately below and adjacent to shim 46. Importantly, however, when rod 110 is in the fully extended position, ball 44 is eccentrically posed with respect to shim 46; a slight majority of the volume of ball 44 is offset to the interior side of a plane defined by the interior face of shim 46. In this position, ball 44 engages the blunt distal face of shim 46 in a manner which prevents rod 110 from easily dropping back into the duct 106 in housing 100. This spring-actuated interengagement between ball 44 and the blunt side of shim 46 acts to releasably retain rod 110 in its extended position.

With shim 46 in direct contact with stop ledge 48, continued upward pulling force is transmitted from handle grip 60 through rod 110 and shim 46 to the stop ledge 48 of housing 100. The friction holding housing 100 in place is overcome, and housing 100 begins to slide upward out of pan 92. The user continues to pull upward on handle grip 60, and housing 100 is thus drawn out of its retracted position until the protruding stop lip 112 contacts retaining cover 114.

Approximately concurrently with the contact of stop lip 112 with retaining cover 114, or immediately prior thereto, the distal end of housing 100 moves past bolt 54, permitting latch spring 50 to urge bolt 54 out of compartment 52. Bolt 54 extends out of compartment 52 sufficiently that the perpendicular (i.e non-oblique with respect to bolt 54) upper surface of the extended bolt 54 contacts the distal corner of housing 100 (solid lines in FIG. 8). Contact between housing 100 and the perpendicular section of bolt 54 securely and reliably locks housing 100 in an extended position. With housing 100 extended and locked, and rods 110, 110' extended and retained, the complete handle assembly 30 is ready to be used to tow the luggage across a supporting surface.

With the handle assembly 30 extended, the user may, if desired, utilize the auxiliary luggage attachment system. Contact plate 148 on belt release 132 is depressed, freeing the belt 130 to be withdrawn from housing 100. While depressing the contact plate 148, the user unhooks the hook 140 from the transverse anchor shaft 128 on housing 100, and pulls belt 130 smoothly out of housing 100. Belt 130 rolls past and unwinds from the rollers 108, 142, shortening the length of the belt contained within housing 100, causing shuttle 134 to slide upward (thereby stretching the constant force spring 138). The extended length of belt 130 is passed around one or more items of auxiliary luggage, or their handles, and is releasably hooked to housing 100. Releasing the belt release 132 permits a spring 157 to engage the leg 146 against the belt 130 to prevent belt 130 from retracting into housing 100. To remove the auxiliary luggage articles, the free end of belt 130 simply is unhooked from the shaft 128 or housing 100 and removed from the auxiliary luggage. The contact plate button is again depressed, and constant force spring 138 pulls the shuttle 134 down, thus winding belt 130 around the rollers 108, 142, and drawing the extended section of belt 130 back through slot 144 and into housing 100. The free end may then be re-hooked to the shaft 128 for storage.

The handle assembly 30 is retracted into the bag 20 in the reverse order of its extension. Handle rods 110,110' are first retracted into housing 100, and housing 100 is then retracted into pan 92. A unique aspect of the invention is that the act of completely inserting rod 110 into housing 100 serves to release the spring-and-bolt lock which holds housing 100 in an extended position. Housing 100 may be retracted into pan 92 only after rod 110 has been inserted into housing 100, because the insertion of rod 110 into housing 100 conveniently and automatically disengages bolt 54 from the distal end of housing 100.

To collapse the handle assembly 30, rod 110 first is retracted into housing 100 by the deliberate action of the user. The retaining action of ball 44 is released by causing shim 46 to serve as a wedge to displace ball 44 into box 40. The user gently yet firmly bumps or presses downward upon the proximate end of rod 110 (for example, by tapping upon handle grip 60 with the palm of the hand). The resulting downward motion of rod 110, which may be quite abrupt, also moves shim 46 downward, wedging shim 46 between rod 110 and ball 44, thus moving ball 44 aside and allowing rod 110 to continue in a downward motion. Because the distal face of shim 46 is blunt (rather than inclined or tapered), however, the displacement of ball 44 by the downwardly moving shim 46 is not inadvertent, but requires mild effort on the part of the user. Once ball 44 has been sufficiently displaced to clear the shim 46 (the condition shown by the phantom lines of FIG. 7), rod 110 may be eased downwardly into housing 100 toward complete retraction. It is noted that extension of rod 110 is more readily achieved than retraction, due to the inclined character of the proximate face of shim 46, which allows a more facile wedging action of shim 46 against ball 44.

Throughout the process of retracting rod 110 by pushing down upon handle grip 60, bolt 54 protrudes to prevent housing 100 from also being pushed down. Only when rod 110 is nearly completely inserted into housing 100 does the process of retracting the housing 100 begin. As illustrated in FIGS. 6 and 8, the complete insertion of rod 110 into housing 100 causes a length of rod 110 to emerge from the distal end of housing 100, near its side corner. The distal end of rod 110 emerges from housing 100 to contact oblique surface of bolt 54. After the rod 110 first contacts the oblique surface it remains in slidable contact therewith. Because the oblique surface is inclined with respect to the longitudinal movement of rod 110, the oblique surface slides across the end of rod 110 and further downward movement by rod 110 initiates an outward lateral displacement of bolt 54. Rod 110 thus pushes bolt 54 in a direction perpendicular to the movement of rod 110, causing bolt 54 partially to retract into compartment 52.

Rod 110 contacts oblique surface when rod 110 is substantially completely retracted into housing 100; only a relatively small amount of further downward movement of rod 110 may occur before limitation by contact of grip 60 with housing 100. The relatively small amount of further movement of rod 110 nevertheless displaces bolt 54 a sufficient distance to disengage from housing 100 the perpendicularly extending section of bolt 54, leaving only the oblique surface portion of bolt 54 to extend from compartment 52.

Disengagement of housing 100 from the perpendicularly projecting portion of bolt 54 frees housing 100 to slide downward a small distance, whereupon the distal corners of housing 100 contact the oblique surface of bolt 54. Housing 100 thereupon assumes the function initiated by rod 110, that is, the function of pushing aside the bolt 54. With continued downward pushing on handle grip 60, the user causes housing 100 to slide still further downward. The continued downward movement of housing 100 induces oblique surface to slide across the distal corner of housing 100, and housing 100 pushes bolt 54 aside, perpendicularly to the movement of housing 100. Bolt 54 eventually is pushed completely clear of the distal end of housing 100, at which point bolt 54 is completely retracted, as shown by the phantom lines in FIG. 8. The tip of bolt 54 continues to push against the side of housing 100, but merely slides against the side and does not prevent housing 100 from further movement into a fully retracted position. Only when housing 100 is extended by the user to a point where the distal end of housing 100 is proximal (above) bolt 54 does bolt 54 re-emerge to lock housing 100 in an extended position (as shown in FIG. 6).

Extension of rods 110,110' from housing 100, and extension of housing 100 from between guide rails 102,102', positions hand grip 60 a sufficient distance from the top fold 116 of closed garment bag 20 to allow a user to conveniently tow the garment bag 20 at an angle which allows the exposed portion of the wheels 96,96' to support the garment bag 20. When garment bag 20 is not being towed and the wheel handle is not needed, rods 110,110' are retracted into housing 100, and housing 100 is withdrawn into the body 22 of the bag 20. Importantly, when the handle is in a completely retracted position, hand grip 60 occupies a position below the profile of the bag 20 (as depicted by the phantom lines of FIG. 2), thus realizing one of the advantages of the invention. Besides offering the wheel handle assembly 30 protection against damage during handling of the garment bag 20, this below-profile position of the collapsed handle assembly 30 allows the small size and shape flexibility of garment bag 20 to be exploited during stowage in confined places.

Figure 13:
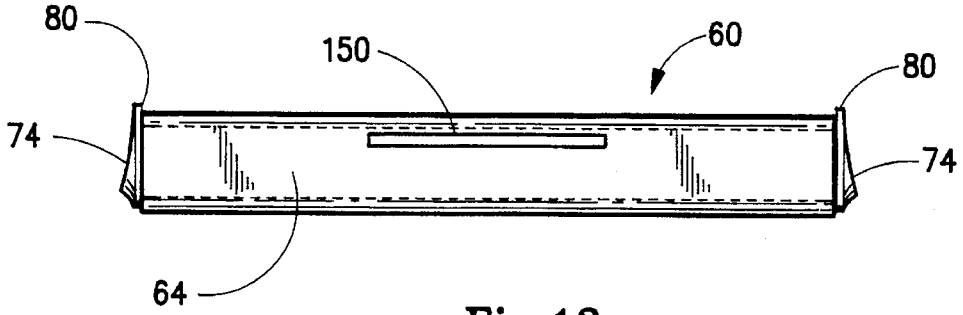
FIG. 13 is a top view of the embodiment of FIG. 12.

FIGS. 13–16 illustrate an added beneficial use for the extendable handle assembly 30 of the invention. When the rod 110 and the housing 100 are fully extended, they are locked into place as shown in FIGS. 15–16. In this extended and locked position, the entire handle assembly 30 (i.e. the housing 100, the rods 110,110' and the handle grip 60) may serve as a prop or stand for holding the bag 20 in an opened position. As shown in FIGS. 14–16, the front flap 118 of the bag 20 has mounted upon its exterior a hooked flange 152, which extends very shortly outward from the flap 118. FIG. 13 shows that handle grip 60 has a groove or slot 150 in the top surface thereof for receiving and holding the hooked flange 152. The slot 150 corresponds in size and shape to the hook on the flange 152, so that hooked flange 152 can be securely, but releasably, engaged into slot 150 on grip 60.

Accordingly, FIGS. 14–16 show that the bag 20 may be opened by unzipping or otherwise detaching the top fold 116 and front flap 118 from the body 22 of the bag 20. With the handle assembly 30 fully extended, the front flap 118 is drawn upward until hooked flange 152 can be engaged into slot 150. With the hooked flange 152 in the slot 150, the bag 20 will maintain itself in a fully opened position, allowing the user free use of both hands to organize the contents of the bag 20. With reference particularly to FIG. 14, the bag 20 may then function essentially as a portable standing valet or wardrobe. With the bag 20 resting upright upon its bottom, the user may access the interior of the opened bag 20 and use it as a small wardrobe by hanging clothing from the clothes hanger trolley 156, using inside pockets, and the like. The extended handle assembly 30 permits such a use to be made in the middle of a room; the opened bag 20 is not required to be leaned against a wall or hung inside a closet.

There may be some tendency for garment bag 20 to collide with the user's legs when the wheeled bag 20 is towed nearly directly behind the user, particularly if the user is long-legged. An advantageous feature of the invention is the extendibility of the hand grip 60 on handle assembly 30. Reference is made to FIGS. 10–13. Extendable hand grip 60 allows the user to extend horizontally (with respect to the supporting surface) the length of hand grip 60, so that garment bag 20 is more easily towed beside, rather than straight behind, the user. With hand grip 60 extended, as in FIG. 10, the user may grasp the projecting inner grip 62 and pull garment bag 20 behind and somewhat to one side, thus providing added clearance for the user's striding legs. In the preferred embodiment, hand grip 60 is readily extendable from either of its ends, allowing either left- or right-handed use in the extended position. The extension is easily reversed, so that hand grip 60 can be restored to ordinary length.

Hand grip 60 includes inner grip 62 and outer grip 64. The entire hand grip 60, including outer grip 64, preferably is shaped as to be comfortably grasped in a user's hand while the garment bag 20 is in a position to be towed. Inner grip 62 and outer grip 64 typically are thus generally cylindrical in shape, the cylinder preferably having a modified oval or elliptical cross section. Outer grip 64 has a hollow tube-like configuration with at least one end, or preferably both ends, open. The preferred embodiment permits hand grip 60 to be extendable from either end, but alternative embodiments may leave open only one or the other of the ends of outer grip 64, so that hand grip 60 is extendable to a single side only.

Continued reference is made to FIGS. 10–13. Inner grip 62 is sized and shaped to correspond very closely, but not identically, to the interior surface of outer grip 64; inner grip 62 may be characterized as a piston which slides within outer grip 64. When hand grip 60 is in a closed or retracted position (FIG. 12), much of the outer surface of inner grip 62 is in slidable contact with the wall 70 of outer grip 64. A minor amount of radial shifting of inner grip 62 within outer grip 64 is acceptable, indeed desirable, to the best mode of practicing the invention. Longitudinal, co-axial sliding movement of inner grip 62 with respect to outer grip 64 is facile and smooth. Preferably either inner grip 62 or outer grip 64 is composed of a durable plastic, such as ABS or of nylon.

Figure 10:
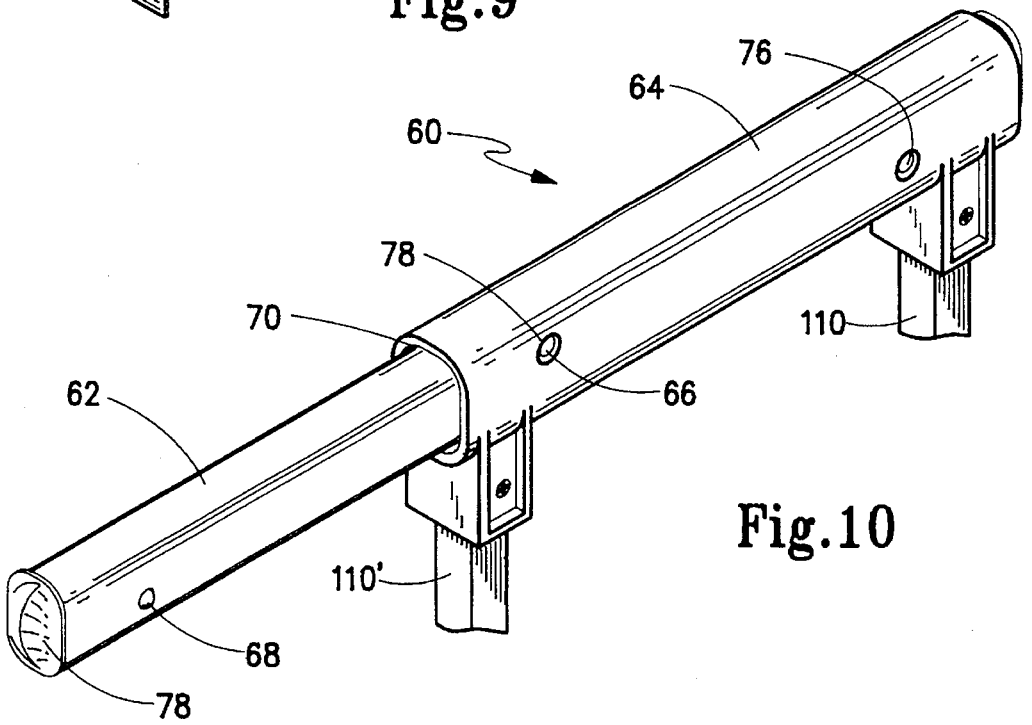
FIG. 10 is an enlarged perspective front view of the handle grip portion of the embodiment of FIG. 1.
Figure 11:
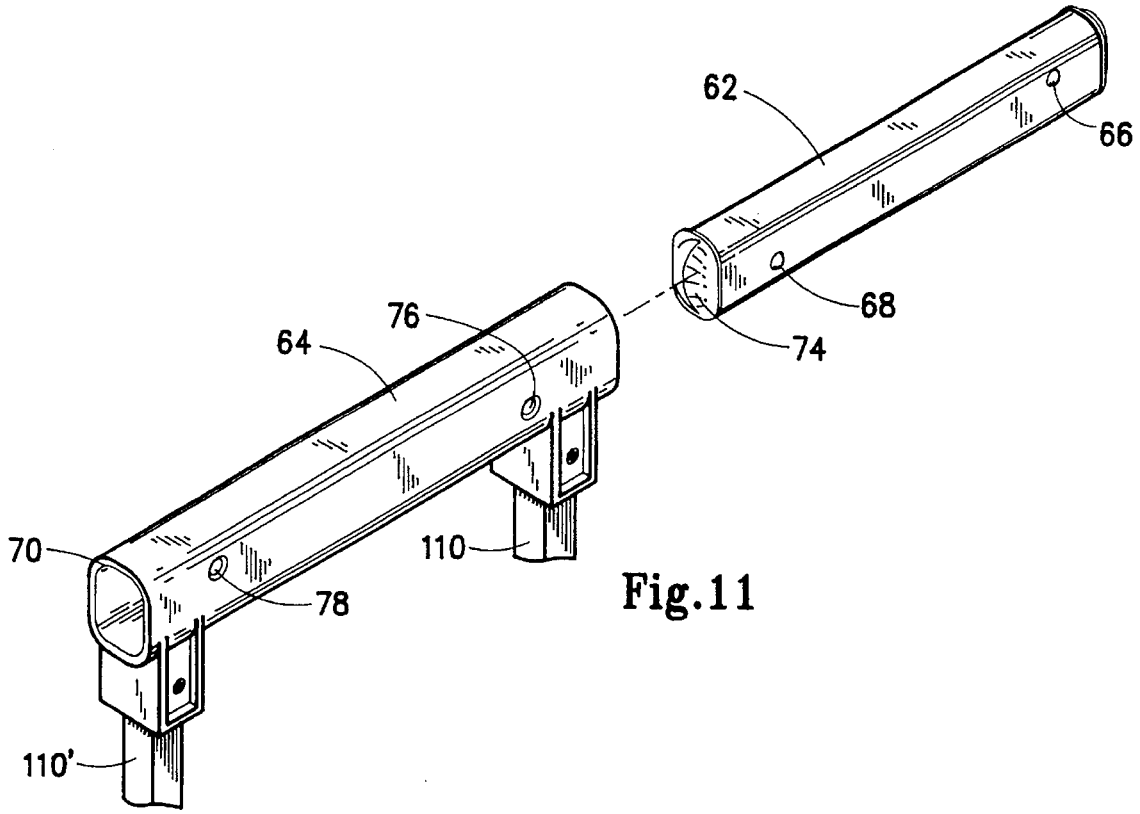
FIG. 11 is an exploded perspective view of the FIG. 10 embodiment.
Figure 12:
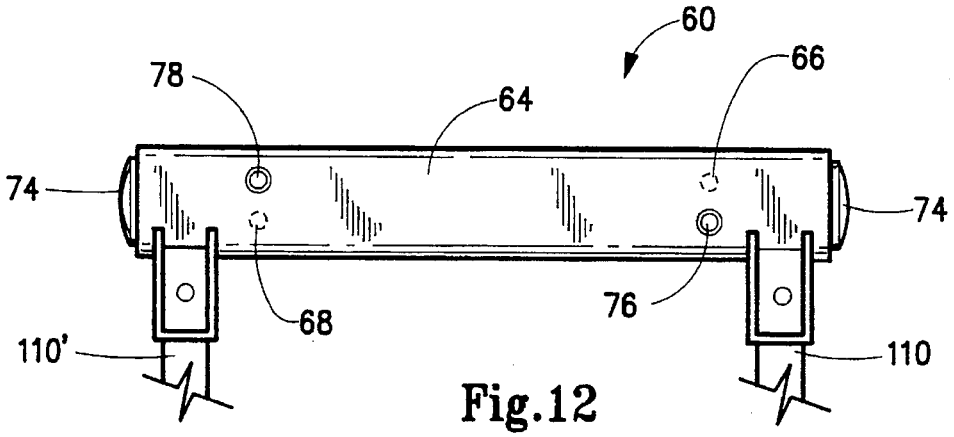
FIG. 12 is a front view of the embodiment of FIG. 10.

As shown in FIGS. 12–13, inner grip 62 has an axial length approximating the length of outer grip 64. Easy manipulation of the invention and its intended purposes recommend that inner grip 62 preferably only modestly exceed outer grip 64 in length. Inner grip 62 may be moved axially such that inner grip 62 may emerge from either end of outer grip 64 to extend the effective length of hand grip 60, as shown in FIGS. 10–11. Inner grip 62 may be extended from outer grip 64 any distance. Complete extension of the full length of inner grip 62 results in the total disengagement of inner grip 62 from outer grip 64 (FIG. 11). Ordinarily, when the extended grip feature is not in use, inner grip 62 will be retracted nearly completely within outer grip 64, as depicted by FIG. 12. In the retracted position, only relatively abbreviated segments of inner grip 62 will protrude from the ends of outer grip 64. In this position, hand grip 60 serves as an ordinary handle for lifting or pulling garment bag 20.

The invention includes elements for locking inner grip 62 in useful positions within outer grip 64. These locking elements consist of catches for positioning and holding inner grip 62 in relation to outer grip 64. The locking elements can be released by a force applied to one of the interlocking parts. In the preferred embodiment, the locking elements consist of at least two detents (preferably spring-operated buttons or balls) mounted in inner grip 62, in operative association with corresponding button apertures through the wall 70 of outer grip 64. As illustrated in FIGS. 10–12, upon inner grip 62 are mounted two spring-actuated button detents 66,68. Button detents 66,68 are mounted within inner grip 62 and in correlation with springs (not shown), in a manner known in the art to bias detents 66,68 radially outward, to protrude from the surface of inner grip 62, unless depressed radially inward by an external force.

Detents 66,68 may be disposed practically anywhere along the axial length of inner grip 62, provided they are axially offset with respect to each other. Preferably, a detent is located near each of the two ends of inner grip 62. Detents 66,68 also preferably are radially offset with respect to one another; that is, not located upon a common line along the longitude of inner grip 62. For ease in describing the interaction of detents with button apertures, button detents 66,68 occasionally will be referred to individually as right-end detent 66 and left-end detent 68.

Continued reference is made to FIGS. 10–12. Penetrating the wall 70 of outer grip 64 are at least two button apertures 76,78. For ease in describing the interaction of button apertures 76,78 with button detents 66,68, these button apertures 76,78 occasionally will be referred to individually as right-end aperture 76 and left-end aperture 78. Button apertures 76,78, like button detents 66,68, are longitudinally offset from each other, and preferably also are radially offset with respect to one another, such that their locations are not upon any common line parallel to the axis of outer grip 64. The exterior surface of wall 70 immediately surrounding button apertures 76,78 is beveled to provide a concave recession nearly as deep as the thickness of wall 70.

As shown in FIG. 12, when inner grip 62 is in a fully retracted position (or nearly so), both detents 66,68 are totally covered by the wall 70 of outer grip 64. In this position, both detents 66,68 are depressed by wall 70, and the springs associated with detents 66,68 are compressed. The biasing force of the compressed springs pushes the button detents 66,68 radially outward against the inner surface of wall 70 of outer grip 64. An opposite reactive force similarly presses the back surface of inner grip 62 against the inside of wall 70. This biasing force, whereby the button detents 66,68 and the back surface of inner grip 62 are pressed by springs against the inside of wall 70 of outer grip 64, serves the useful function of frictionally holding the retracted inner grip 62 in the position shown in FIG. 12. The friction between inner grip 62 and outer grip 64 maintains their relative positions unless an external force is applied on an end of inner grip 62 (breaking the friction and causing inner grip 62 to slide within outer grip 64).

Reference is made to FIGS. 12 and 13. Each end of inner grip 62 preferably is specially shaped to include locking lip 80 and push tab 74. The ends of inner grip 62 are reflections of one another, and description of one suffices to describe them both. Locking lip 80 protrudes slightly rearward from the end of inner grip 62. As mentioned, the force occasioned by the compression of the detent springs tends to bias inner grip 62 rearwardly within outer grip 64. When inner grip 62 is in a fully retracted position, this spring bias causes the locking lip 80 at both ends of inner grip 62 to project and catch the corresponding end of wall 70 of outer grip 64, as shown in FIG. 13. Each end of outer grip 64 thus serves as a stop to further movement of inner grip 62 into outer grip 64.

The engagement of locking lip 80 with outer grip 64, whereby either end of outer grip 64 retains inner grip 62 in its fully retracted position by preventing inner grip 62 from inadvertently sliding in either direction, is releasable by the user. Should the user desire to disengage the locking lip 80 in order to push inner grip 62 into the outer grip 64 (thus extending inner grip 62 from the opposite end of outer grip 64), the user merely pushes upon push tab 74. Pushing somewhat forward upon tab 74 further compresses the detent springs, allowing inner grip 62 to shift radially slightly forward within outer grip 64, which in turn clears locking lip 80 from the edge of the outer grip wall 70. The locking lip 80 is then pushed axially inwardly into the interior of outer grip 64, allowing inner grip 62 to slide into outer grip 64. The functions of the locking lip 80 and push tab 74 at either end of inner grip 62 are identical, permitting inner grip 62 to be moved axially either direction within outer grip 64.

As best illustrated in FIG. 12, the location of left-end aperture 78 does not directly correspond to the location of left-end detent 68, and the location of right-end aperture 76 does not directly correspond to the location of right-end detent 66. The relative locations of detents 66,68 and apertures 76,78 provide that left-end detent 68 functions in correlation with right-end aperture 76, and right-end detent 66 functions in correlation with left-end aperture 78.

The radial offset of right-end detent 66 on inner grip 62 corresponds to the radial offset of left-end aperture 78. Consequently, right-end detent 66 can be directly aligned with left-end aperture 78 by slidably shifting inner grip 62 within outer grip 64 until the respective longitudinal positions of right-end detent 66 and left-end aperture 78 coincide, as shown in FIG. 10. When hand grip 60 is in this configuration, right-end detent 66 emerges through, and engages with, left-end aperture 78. The left-end detent 68 is free and clear of outer grip 64. The engagement of right-end detent 66 through left-end aperture 78 checks any further unintended movement of inner grip 62, and temporarily locks inner grip 62 in the extended position for use. This temporary locking prevents inner grip 62 from retracting within outer grip 64, and also prevents inner grip 62 from sliding completely out of, and disengaging from, outer grip 64.

The lock of inner grip 62 in the extended position shown in FIG. 10 may be released by depressing the right-end detent 66 until it clears wall 70, while simultaneously sliding inner grip 62 within outer grip 64. Because apertures 76,78 are at the center of a concave depression, the user of the invention easily is able to depress either of the detents 66,68 inward, clear of the wall 70, by placing a fingertip in the depression and pushing inward. With right-end detent 66 maintained in a depressed condition, it can be disengaged from left-end aperture 78 and moved under wall 70; wall 70 will maintain right-end detent's depressed condition in all other positions of inner grip 62 (unless detent 66 is re-aligned with left-end aperture 78 or is moved clear of either end of outer grip 64).

Essentially identical functions allow inner grip 62 to be extended from the opposite end of outer grip 64. The radial offset of left-end detent 68 on inner grip 62 corresponds to the radial offset of right-end button aperture 76. Consequently, left-end detent 68 can be aligned with right-end aperture 76 by slidably shifting inner grip 62 within outer grip 64 until the respective longitudinal positions of left-end detent 66 and right-end aperture 76 coincide. When hand grip 60 is in this configuration, left-end detent 68 emerges through, and engages with, right-end aperture 66. The engagement of left-end detent 68 through right-end aperture 76 performs the same positioning and locking functions as described immediately above, the release of the lock is performed in the same manner, and the discussion of the foregoing paragraph may here be repeated by reference; (the overall configuration of hand grip 60 is merely reversed, with inner grip 62 projecting from the opposite end of outer grip 64). The lock of the position can be released by depressing left-end detent 68.

It is noted that either of button detents 66,68 is maintained in a depressed state, and in frictional contact with the interior of the wall 70 of outer grip 64, unless and until it is aligned with a button aperture 76,78 or is drawn clear of an end of outer grip 64. In the preferred embodiment, this means that at least one detent is depressed and in frictional contact with the inside of the wall 70 of outer grip 64 at all times (except when inner grip 62 is removed completely from outer grip 64). This constant friction between a button detent and the inside of wall 70 of outer grip 64 (and the concomitant friction between the surfaces of inner grip 62 and outer grip 64 opposite the detent) serves mildly to retard the sliding movement of inner grip 62 within outer grip 64. The drag resulting from this frictional engagement offers the advantage of more controlled manipulation of inner grip 62.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of the patents cited hereinabove are hereby incorporated by reference.

We claim:

1. In an article of luggage having a main body defining an interior space in which clothing and like personal items can be contained, the main body including wheel means upon which the main body can be rolled along a supporting surface, and a wheel handle for gripping the luggage and moving it along the supporting surface, an improvement in the wheel handle comprising:

an intermediate handle member movable from a position substantially retracted relative to said main body to a position at least partially extended from said main body;

means upon said main body for guiding the movement of said intermediate handle member, said intermediate handle member in slidable contact with said guiding means;

proximate handle means reversibly retractable into and extendable from said intermediate handle member;

retainer means connected to said intermediate handle member, whereby said retainer means is movable in conjunction with said intermediate handle member, and wherein said retainer means is retracted into said main body when said intermediate handle member is in a position substantially retracted relative to said main body;

means, movable from a stored position at least partially on said retainer means, for releasably securing auxiliary luggage to the first mentioned article of luggage; and an extendable grip disposed upon said proximate handle means, said extendable grip comprising:

an outer grip, comprising a wall and an interior space at least partially defined by said wall;

an inner grip slidably disposed within said outer grip and extendable from and retractable into said interior space; and means for temporarily locking said inner grip in a position extended from said interior space.

2. An apparatus according to claim 1, wherein said outer grip comprises a substantially tubular member, said tubular member comprising:

a first open end; and a second open end.

3. An apparatus according to claim 2 wherein said inner grip further comprises:

a first end;

a second end; and wherein said first end is extendable from said first open end of said outer grip, and said second end is extendable from said second open end of said outer grip.

4. An apparatus according to claim 3, wherein said means for temporarily locking said inner grip comprises:

means for temporarily locking said first end in a position extended from said first open end of said outer grip; and means for temporarily locking said second end in a position extended from said second open end of said outer grip.

5. An apparatus according to claim 4, wherein said means for temporarily locking said first end comprises:

at least one aperture in said wall; and at least one detent protruding from and depressible into said inner grip and engageable with said aperture.

6. An apparatus according to claim 1 wherein said means for releasably securing auxiliary luggage comprises belt means extendable from said retainer means.

7. An apparatus according to claim 6 further comprising:

shaft means disposed upon said intermediate handle member, and wherein said belt means further comprises one end thereof anchored to said intermediate handle member and a free end extendable around at least a portion of the auxiliary luggage, said free end including a hook thereon, said hook being releasably engageable with said shaft means.

8. An apparatus according to claim 6 wherein said means for releasably securing further comprises:

at least one roller means around which said belt means can be wrapped when said belt means is in the stored position; and means for biasing said belt into the stored position.

9. An apparatus according to claim 8 further comprising releasable clamp means operatively engageable with said belt means to selectively retain said belt means in its extended position.

10. An apparatus according to claim 8 further comprising a slidable shuttle connected to a roller means and operably connected to said means for biasing.

11. An extendable handle apparatus comprising:

an outer grip, comprising a substantially tubular member, said tubular member comprising a first open end, a second open end, a wall and an interior space at least partially defined by said wall;

an inner grip, comprising a first end and a second end, slidably disposed within said outer grip and extendable from and retractable into said interior space; and means for temporarily locking said inner grip in a position cantilevered from said outer grip; and wherein said first end is extendable from said first open end of said outer grip, and said second end is extendable from said second open end of said outer grip.

12. An apparatus according to claim 11, wherein said means for temporarily locking said inner grip comprises means for temporarily locking said first end in a position extended from said first open end of said outer grip.

13. An apparatus according to claim 11, wherein said means for temporarily locking said inner grip comprises means for temporarily locking said second end in a position extended from said second open end of said outer grip.

14. An apparatus according to claim 11, wherein said means for temporarily locking said inner grip comprises:

means for temporarily locking said first end in a position extended from said first open end of said outer grip; and means for temporarily locking said second end in a position extended from said second open end of said outer grip.

15. An apparatus according to claim 14, wherein said means for temporarily locking said first end comprises:

at least one aperture in said wall; and a detent protruding from and depressible into said inner grip, and engageable with said aperture.

* * * * *